US005671630A

United States Patent [19]

Grober

[11] Patent Number: 5,671,630

[45] Date of Patent: Sep. 30, 1997

[54] METHOD FOR ROLLING Z-SECTION SHEET PILES

[75] Inventor: Henri Grober, Esch sur Alzette, Luxembourg

[73] Assignee: ProfilARBED, S.A., Luxembourg

[21] Appl. No.: 564,025

[22] Filed: Nov. 29, 1995

[30] Foreign Application Priority Data

Dec. 7, 1994 [LU] Luxembourg ..... 88 566

[51] Int. Cl.[6] ..... B21B 13/12; B21B 1/12

[52] U.S. Cl. ..... 72/177; 72/225; 72/234

[58] Field of Search ..... 72/177, 178, 181, 72/225, 224, 366.2, 234

[56] References Cited

U.S. PATENT DOCUMENTS 4,279,139 7/1981 Schmitz ..... 72/234

FOREIGN PATENT DOCUMENTS 47784 12/1972 Japan ..... 72/234
288903 10/1992 Japan ..... 72/234
1547914 3/1990 U.S.S.R. ..... 72/181

*Primary Examiner*—Daniel C. Crane
*Attorney, Agent, or Firm*—Fishman, Dionne, Cantor & Colburn

[57] ABSTRACT

A method is presented for hot rolling a Z-section sheet pile from a semi-finished H-beam. The semi-finished H-beam is oriented in such a way that its web is substantially parallel to a rolling plane. A preform of the sheet pile is first rolled in a first plurality of rolling passes to form a preform having two flange/web transition sections substantially parallel to the rolling plane. These two flange/web transition sections connect rough-rolled portions for the sheet pile flanges to a middle section which is oblique to the rolling plane. A final Z-section sheet pile is formed from the preform in a second plurality of rolling passes.

11 Claims, 2 Drawing Sheets

METHOD FOR ROLLING Z-SECTION SHEET PILES

BACKGROUND OF THE INVENTION

This invention relates to a method for hot rolling Z-section sheet piles from semi-finished H-beams. More particularly, this invention relates to a method for hot rolling Z-section sheet piles from continuously cast H-beam blanks. As used herein, the term H-beam includes any H-section product.

Until recently, steel sections such as beams, sheet piles and angle irons were rolled from an initial rectangular section, but the current tendency is to use preforms obtained by continuous casting, which reduces the stages of rolling necessary in order to arrive at the finished steel section. In particular, it is becoming increasingly common to use this method for hot-rolling H-beams from continuously cast beam blanks which are already H-shaped. The methods used for the continuous casting of these beam blanks are well known.

As regards sheet piles, a method does not yet exist for the continuous casting of preforms specifically cast for sheet piles. Unlike beams, whose H-shaped cross-section has two planes of symmetry, sheet-pile cross-sections have in effect only one plane of symmetry in the case of U-section sheet piles and no plane of symmetry in the case of Z-section sheet piles. The continuous casting of steel sections having a shape close to that of the finished sheet piles is therefore not as easy from the technical point of view as the continuous casting of beam blanks with two planes of symmetry for beams.

Since sheet piles are often rolled on the same roll trains as beams, it would be attractive to be able to produce sheet piles, and particularly Z-section sheet piles, from H-section beam blanks in order, on the one hand, to limit the number of continuously cast beam-blank sections and, on the other hand, to avoid at the same time problems related to the continuous casting of special sections for sheet piles.

A method for rolling Z-section sheet piles from beam blanks has been described in patent application JP-A-4/288903. That application describes a method of rolling which converts, in a first stage of rolling, the semi-finished H-beam into a preform of the Z-section sheet pile which already has, apart from the preform of the claws, the final geometry of the sheet pile. The second stage of the rolling is mainly devoted to work in roughing down the web and flanges and to rolling the claws. The overall shape of the Z-section shows almost no further change. This rolling method requires complicated upsetting of the material, which can create defects such as, for example, laps in the angles between the web and the flanges of the sheet pile.

SUMMARY OF THE INVENTION

The present invention discloses a method of rolling especially suited to the hot rolling of a Z-section sheet pile from a semi-finished H-beam through a series of preform forming passes.

Instead of directly rolling, from a semi-finished H-beam, a preform geometrically similar to the Z-section sheet pile, the method of this invention proceeds through a preform comprising two flange/web transition sections substantially parallel to the rolling plane (the plane parallel to the rotation axis of the rolling mill rolls). These two flange/web transition sections connect the rough-rolled portions for the flanges of the sheet pile to a middle section oblique to the rolling plane. This method of formation makes it possible to distribute the material from the flange tips of the semi-finished H-beam very simply, either into the rough-rolled portions for the flanges/claws or into the two flange/web transition sections.

The two flange/web transition sections and the said middle section therebetween advantageously form a curved preform of the web of the said sheet pile. In order to simplify the rolling work, this curved preform is maintained during the whole of the roughing down stage. It is only towards the end of the rolling process that the curved preform of the web is flattened in order to form the final web of the sheet pile. In this way it is possible to reduce the necessary width of the rolling; this consequently makes it possible either to work with rolling mill rolls that are not so wide or to roll wider sheet piles in a given rolling mill. In this context, it should be recalled that, at a given modulus of elasticity, the use of a wider sheet pile makes possible a reduction of about 15% in weight per $m^2$ of the sheet pile wall. It will therefore be appreciated that, by allowing wider sections of sheet piles to be rolled on an existing rolling mill, the present invention also produces a considerable economic advantage.

The process of this invention starts with a semi-finished H-section product such as an H-beam blank (see FIG. 1 (0)) and proceeds through a series of forming passes to eventually form a Z-section sheet pile. It is to be noted that the flange tips of the semi-finished H-beam are numbered A1, A2, A3, A4 in succession going clockwise around the H-section.

In a first stage of the rolling, it is an advantage mainly to produce a flattening of the flange tips A2 and A4 and a further lateral separation of the flange tips A1 and A3. The upsetting of the material of the semi-finished H-beam during its roughing down may be broadly characterized as follows:

- the major part of the flange tips A2 and A4 passes into transition sections,
- the material from the flange tips A1 and A3 passes into the preforms of the two lateral flanges and into the preforms of the claws, and
- the middle section is formed almost entirely of material originating in the web of the semi-finished H-beam.

Preferably, the middle section connecting the two flange/web transition sections is rolled in such a way as to make with the rolling plane an angle $\alpha$ which progressively increases to a maximum value $\alpha(max)>\alpha_0$, where $\alpha_0$ is the angle which the final web makes with the rolling plane. Towards the end of the rolling process this angle $\alpha(max)$ is then reduced to the final value $\alpha_0$. This method of proceeding makes it possible to gain a maximum amount of space as far as the width of rolling is concerned. That is, since the rolled product gets its final width only towards the end of the rolling process, the rolls for most rolling passes have a reduced width compared to the final width of the Z-section sheet pile.

It will be appreciated that the present invention also describes a method whereby the rolling of the flanges and claws of the sheet pile can be optimized. Preferably, for each of the two rough-rolled portions for the flanges, a preform of the claw, a claw/flange transition section which is substantially parallel to the rolling plane, and a connecting section between the claw/flange transition section and the flange/web transition section are rolled. The claw/flange transition section, which is substantially parallel to the rolling plane, considerably simplifies the upsetting of the material in the region of the flange/claw preform and also facilitates the rolling of the claw. The claw is initiated by the rolling of a groove in the preform of the claw in a direction perpendicular to the rolling plane. Towards the end of the rolling, the claw/flange transition section and the connecting section between the claw/flange transition section are then flattened and oriented in order to form a plane flange making an angle $\beta_0$ with the rolling plane.

BRIEF DESCRIPTION OF THE DRAWINGS

The present invention will be better understood by reference to the example illustrated in the appended drawings.

DESCRIPTION OF THE PREFERRED EMBODIMENT

Figure 1:
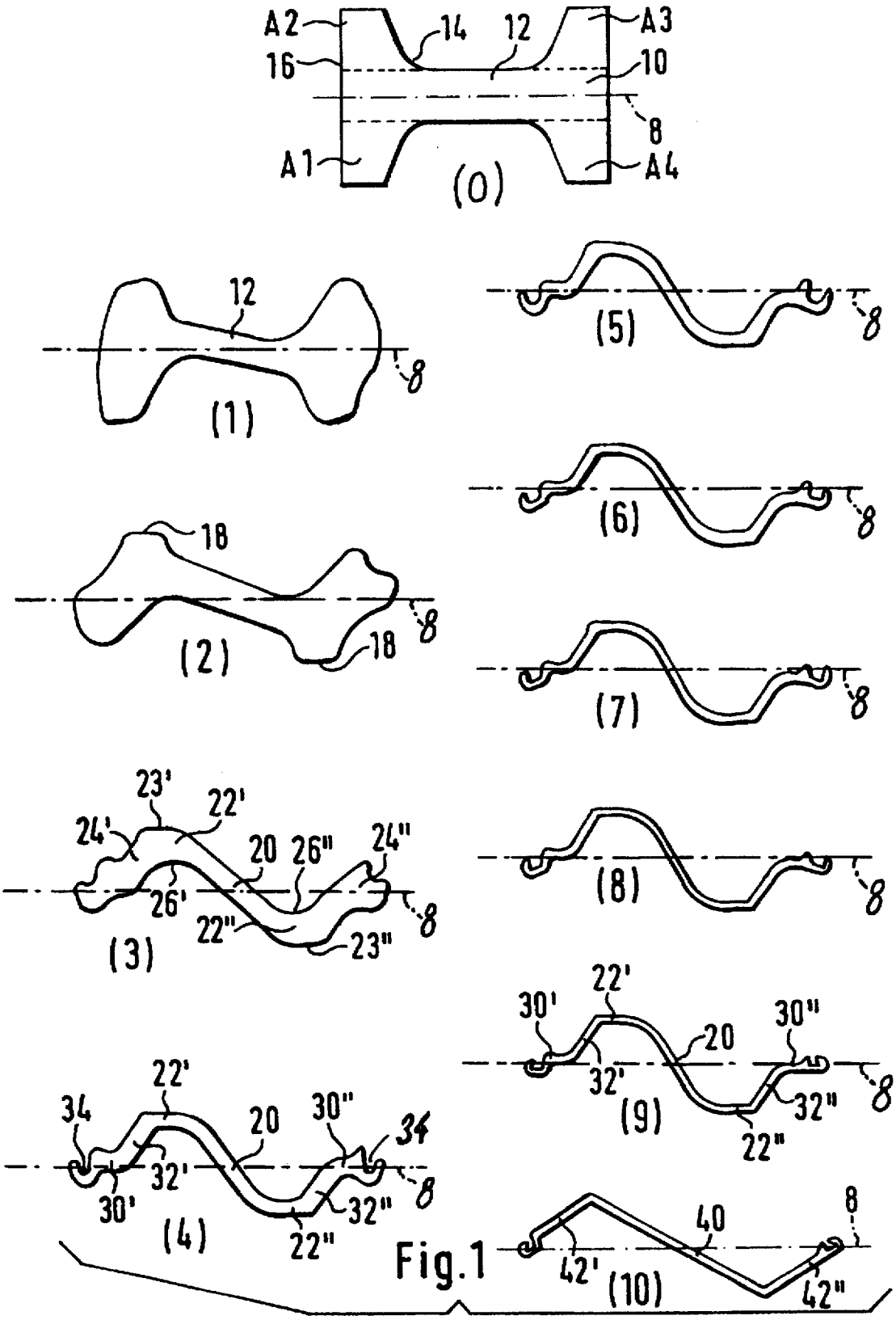
FIG. 1 shows the progressive development of the Z-section cross-section of the rolled sheet pile in the method of rolling according to the present invention, starting with a continuously cast H-section preform at (0) and progressing through rolling passes or stages (1)–(10).

FIG. 1 shows, in passes or stages (0)–(10), an illustrative example of the present invention, the progressive development of the cross-section of the rolled product during the rolling of an "AZ 36" sheet pile with LARSSEN®-type interlocking claws from a continuously cast H-section beam blank 10. The initial beam blank 10 (FIG.1 (0)) has two planes of symmetry and may be divided into 5 parts: a web 12 which, when being rolled, is oriented parallel to the rolling plane 8 (plane parallel to the rotation axis of the rolling mill rolls not shown), and four flange tips, numbered successively A1, A2, A3, A4 going clockwise around the beam blank. The flange tips A1, A2, A3, A4 are connected to the web 12 by rounded portions 14. The outer opposite lateral faces 16 of the two branches of the H-section beam blank are plane and perpendicular to the web. It is to be noted that the aggregate cross-sectional area of the four flange tips is slightly greater than the cross-sectional area of the web.

During the first rolling pass (FIG. 1(1)), the middle part of the web 12 of the beam blank is slightly thinned and receives an orientation oblique with respect to the rolling plane 8. The flange tips A2 and A4 are flattened parallel to the rolling plane, and the flange tips A1 and A3 are rounded. A slight bulge occurs at the center of the opposed lateral faces 16 of the beam blank 10.

During pass 2 (FIG. 1 (2)), the flange tips A2 and A4 are further flattened so as to have plane surfaces 18 parallel to the rolling plane. The flange tips A1 and A3 are moved further apart laterally towards the outside. It is to be noted that all the concave junctions in the cross-section are produced using curves with large radii of curvature.

Upon completion of pass 3 (FIG. 1 (3)), it is possible to distinguish an oblique middle section 20, two flange/web transition sections 22', 22" and the rough-rolled portions 24', 24" for the future flanges and claws of the final sheet pile. The two flange/web transition sections 22', 22" are located at the position formerly occupied by the flange tips A2 and A4 and are substantially parallel to the rolling plane 8. It is to be noted that on the convex side the flange/web transition sections 22', 22" have substantially plane surfaces 23', 23" and that on the opposite side there is sufficient space for concave junctions 26', 26" with large radii of curvature. These concave junctions 26', 26" connect the oblique middle section 20 to the rough-rolled portions 24', 24" for the future flanges and claws of the final sheet pile. Angle $\alpha$ is defined between the oblique middle section 20 and the rolling plane 8 (see, e.g., FIGS. 2*a* and 2*b*). It is to be noted that the angle $\alpha$ has increased at pass 3 and that the former flange tips A2 and A4 have completely disappeared. The material in them has passed mainly into the flange/web transition sections 22', 22" but also into the rough-rolled portions 24', 24" for the flanges. The progressive flattening of the flange tips A2 and A4 parallel to the rolling plane, which produces the flange/web transition sections 22', 22", and the concave junctions 26', 26" with large radii of curvature, make it possible to reduce significantly the risk of forming surface defects such as laps.

Pass 4 (FIG. 1 (4)) forms the end of the first stage of rolling, which consists in passing from the H-section beam blank to a preform of the Z shaped sheet pile in the shape of a folded Z. It is now possible to distinguish clearly the oblique middle section 20, whose angle $\alpha$ made with the rolling plane 8 has once again increased, and the flange/web transition sections 22', 22" parallel to the rolling plane. The rough-rolled portions 24', 24" for the future flanges and claws of the final sheet pile have been thinned further. A groove 34 has been rolled into the preforms of the claws perpendicular to the rolling plane 8. A distinction can begin to be made between the claw/flange transition sections 30', 30" substantially parallel to the rolling plane; and the connecting sections 32', 32", which connect the claw/flange transition sections 30', 30" to the flange/web transition sections 22', 22" and which make an angle $\beta$ with the rolling plane 8. Angle $\beta$ is defined between each of the connecting sections 32' and 32" and the rolling plane 8 (see, e.g., FIGS. 2*a* and 2*b*).

It is to be noted that the two flange/web transition sections 22', 22" and the oblique middle section 20 constitute a curved preform of the web of the final sheet pile, while each pair composed of one claw/flange transition section 30', 30" and one connecting section 32', 32" constitutes a curved preform of the flange of the final sheet pile.

The following stages of the rolling, i.e., passes (5)–(9) (FIGS. 1(5)–1(9)) are mainly devoted to a progressive roughing down of the curved or folded preform of the sheet pile and to the rolling of the claws. Unlike what happens during a conventional rolling of Z-section sheet piles, the roughing down is carried out entirely on the curved preform of the Z-section sheet pile. In this way, it is possible inter alia to take advantage of the radii of the junctions as regards the convex parts of the sheet pile. The curved shape of the future flanges facilitates inter alia the rolling of the claws, since the latter are almost parallel to the rolling plane 8 and are therefore very accessible. During the roughing down of the curved web, the angle $\alpha$ remains almost constant and is significantly greater than the angle $\alpha_0$ measured on the final sheet pile (see FIG. 2).

Up to pass 9, the preform of the claws has an open shape, which facilitates its roughing down (see, e.g., FIGS. 1(5)–1(8)). At pass 9 (FIG. 1(9) and 2*a*), the roughing down having finished, the claws are partially closed up in order to give them their definitive shape. In addition, during pass 9, the various walls have substantially acquired their final thicknesses. The final rolling pass will be used only to straighten the sheet pile (see FIG. 1(10) and 2*b*). In the final pass 10 (FIG. 1(10) and 2*b*), the two flange/web transition sections 22', 22" parallel to the rolling plane (whose aggregate length may also represent between 15% and 75% of the final length of the web of the sheet pile) and the middle section 20 are straightened so as to form a straight section forming the final plane flange or web 40 of the sheet pile. This deformation is accomplished by a reduction in the angle $\alpha$ to the value $\alpha_0$, which is the angle made between the web 40 of the final sheet pile and the rolling plane. In the same way, the claw/flange transition sections 30', 30" and the connecting sections 32', 32" are straightened in pass 10 in order to form the flanges 42', 42" of the final sheet pile, the angle $\beta$ increasing to reach its final value $\beta_0$.

Figure 2A:
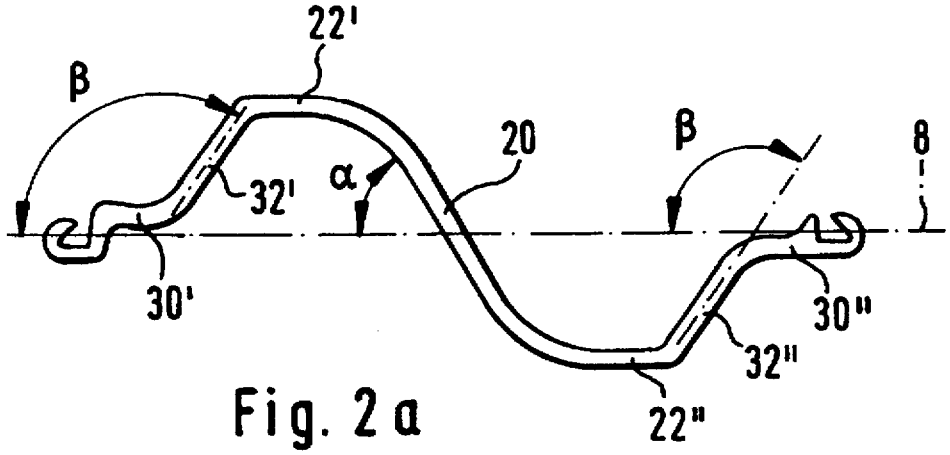
FIG. 2(*a*) is an enlarged illustration of pass or stage (9) of FIG. 1 showing the cross-section of a preform, according to the invention, of the sheet pile which precedes the final rolling stage producing the final form of the sheet pile, and FIG. 2 (6)) is an enlarged illustration of pass or stage (10) of FIG. 1 showing the final shape of the Z-section sheet pile.
Figure 2B:
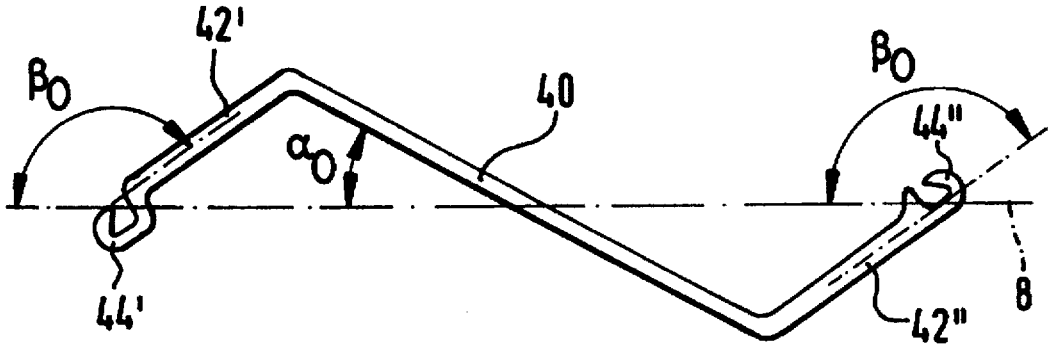

FIGS. 2*a* and 2*b* are enlarged showings, respectively, of pass 9 (FIG. 1 (9)) and pass 10 (FIG. 1(10)) showing the angular relationship $\alpha$ and $\beta$ more closely.

Note that different types of beam blanks, whether or not continuously cast, may be used with the rolling method according to the present invention. Depending on the width of the sheet piles to be rolled, it may prove necessary to carry out, prior to the rolling proper, an upsetting enabling the height of the beam blank to be adjusted to the width of the steel section in question.

In the above example, the present invention has been applied to the case of a Z-section sheet pile fitted with LARSSEN-type claws 44', 44" (see FIG. 2*b*). It may however be applied to the rolling of Z-section sheet piles fitted with any other type of claw.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method for hot rolling a Z-section sheet pile from a semi-finished H-section product, which H-section product has a rolling plane, a web, and four flange tips, the method including the steps of:

introducing said H-section product in a rolling mill train having a plurality of rotating rolls and a rolling plane parallel to the rotation axes of said rotating rolls, the web of said H-section product being parallel to said rolling planes;

performing a first plurality of rolling passes on said semi-finished H-section product to form a Z-section sheet pile preform having (a) first and second rough-rolled preforms of the lateral flanges and claws of the Z-section sheet pile to be formed, (b) a middle section oblique to said rolling plane, and (c) first and second flange/web transition sections connecting said middle section respectively to said first and second rough-rolled preforms of the lateral flanges and claws, said first and second flange/web transition sections being flattened so as to be substantially parallel to said rolling plane; and performing a second plurality of rolling passes on said Z-section sheet pile preform to form a Z-section sheet pile having a plane web, two lateral flanges connected to said web, and a claw terminating each of said lateral flanges.

2. The method of claim 1, wherein said two flange/web transition sections and said middle section form a curved preform of the web of the said sheet pile.

3. The method of claim 2, wherein towards the end of said second plurality of rolling passes, said curved preform of the web is flattened to form said plane web of the sheet pile.

4. The method of claim 1, wherein each of said first and second flange/web transition sections of said Z-section sheet pile preform is formed to have on one side a substantially plane surface and on the other side a curved concave surface.

5. The method of claim 1 wherein first and second of said flange tips are opposed and third and fourth of said flange tips are opposed, and wherein during said first plurality of rolling passes:

the major part of the material from opposed first and second flange tips passes into said flange/web transition sections;

the material from opposed third and fourth flange tips passes into said preforms of said lateral flanges; and said middle section is formed almost entirely from material originating from the web of the semi-finished H-beam.

6. The method of claim 1, wherein said middle section connecting said two flange/web transition sections makes an angle $\alpha$ with the rolling plane, which angle is progressively increased up to its maximum value $\alpha$(max); and in that, towards the end of the rolling process, said angle $\alpha$(max) is reduced to a final value $\alpha_0$.

7. The method of claim 1 wherein, in a first pass of said first plurality of rolling passes, the main effect produced is a flattening of opposed first and second flange tips and a further lateral separation of opposed third and fourth flange tips.

8. The method of claim 1 wherein, in the formation of each of said first and second rough-rolled portions for the lateral flanges of the Z-section sheet pile, a preform of a claw, a claw/flange transition section substantially parallel to the rolling plane, and a connecting section between the claw/flange transition section and the flange/web transition section are rolled.

9. The method of claim 8, wherein, towards the end of said second plurality of rolling passes, said claw/flange transition section and said connecting section between said claw/flange transition section and said flange/web transition section are flattened in order to form a substantially straight flange making an angle $\beta_0$ with the rolling plane.

10. The method of claim 9, wherein, after having rolled the claw/flange transition section which is substantially parallel to the rolling plane, a groove is rolled in the preform of the claw in a direction perpendicular to the rolling plane.

11. A method for hot rolling a Z-section sheet pile from a semi-finished H-section product, which H-section product has a rolling plane, a web, and four flange tips, the method including the steps of:

introducing said H-section product in a rolling mill train having a plurality of rotating rolls and a rolling plane parallel to the rotation axes of said rotating mils, the web of said H-section product being parallel to said rolling planes;

performing a first plurality of rolling passes on said semi-finished H-section product to form a Z-section sheet pile preform having (a) first and second rough-rolled preforms of the lateral flanges and claws of the Z-section sheet pile to be formed, (b) a middle section oblique to said rolling plane, and (c) first and second flange/web transition sections connecting said middle section respectively to said first and second rough-rolled preforms of the lateral flanges and claws, said first and second flange/web transition sections being flattened so as to be substantially parallel to said rolling plane the width of each of said flange/web transition sections substantially parallel to the rolling plane exceeding at least 15% of the final width of said plane web; and performing a second plurality of rolling passes on said Z-section sheet pile preform to form a Z-section sheet pile having a plane web, two lateral flanges connected to said web, and a claw terminating each of said lateral flanges.

* * * * *